United States Patent [19]

Nakamura

[11] 4,408,591

[45] Oct. 11, 1983

[54] INJECTION TIMING CONTROL DEVICE FOR DISTRIBUTOR-TYPE FUEL INJECTION PUMPS

[75] Inventor: Hisashi Nakamura, Higashi-Matsuyama, Japan

[73] Assignee: Diesel Kiki Co., Ltd., Tokyo, Japan

[21] Appl. No.: 319,787

[22] Filed: Nov. 9, 1981

[30] Foreign Application Priority Data

Nov. 15, 1980 [JP] Japan ..... 55-161189

[51] Int. Cl.[3] ..... F02M 59/20

[52] U.S. Cl. ..... 123/502

[58] Field of Search ..... 123/502, 501; 417/462

[56] References Cited

U.S. PATENT DOCUMENTS

| | | | |
|---|---|---|---|
| 3,051,154 | 8/1962 | Kemp | 123/502 |
| 3,433,159 | 3/1969 | Kemp | 123/502 |
| 3,447,520 | 6/1969 | Drori | 123/502 |
| 3,552,366 | 1/1971 | Kemp | 123/502 |
| 3,897,764 | 8/1975 | Bakti | 123/502 |
| 4,037,574 | 7/1977 | Swift | 123/502 |
| 4,074,667 | 2/1978 | Skinner | 123/502 |
| 4,329,961 | 5/1982 | Johnston | 123/502 |

FOREIGN PATENT DOCUMENTS

| | | | |
|---|---|---|---|
| 2345724 | 3/1974 | Fed. Rep. of Germany | 123/502 |

*Primary Examiner*—Ira S. Lazarus
*Assistant Examiner*—Magdalen Moy
*Attorney, Agent, or Firm*—Frishauf, Holtz, Goodman and Woodward

[57] ABSTRACT

A servo valve is arranged within a timer piston for displacement in response to fuel pressure variable as a function of the engine rpm. When there occurs a change in the fuel pressure, the servo valve is automatically displaced relative to the timer piston to open a passageway for supplying the above fuel pressure to a hydraulic oil chamber defined at one end of the timer piston to cause displacement of the timer piston for control of injection timing. When there is no change in the fuel pressure, the servo valve is positioned to close the passageway to hold the timer piston stationary. Further, means may be provided for adjusting the setting load of a servo spring urging the valve body of the servo valve against the above fuel pressure.

3 Claims, 5 Drawing Figures

INJECTION TIMING CONTROL DEVICE FOR DISTRIBUTOR-TYPE FUEL INJECTION PUMPS

BACKGROUND OF THE INVENTION

This invention relates to distributor-type fuel injection pumps for internal combustion engines, and more particularly to an injection timing control device for such pumps.

A distributor-type fuel injection pump for use with a diesel engine is generally provided with an injection timing control device which is usually called "a timer" and which is adapted to automatically advance the injection timing as the engine rpm increases. Such injection timing control device comprises a roller holder carrying a plurality of rollers circumferentially arranged and disposed in camming engagement with an end face of a pumping and distributing plunger connected to the output shaft of an engine, a timer piston coupled to the roller holder and arranged to be urged at its one end face by fuel pressure variable as a function of the engine rpm supplied from the suction chamber of the pump, and a timer spring arranged to urge the timer piston against the above fuel pressure. The timer piston is therefore displaceable in response to a change in the engine rpm to cause a corresponding change in the circumferential position of the roller holder, which in turn causes a change in the axial operative position of the plunger relative to the circumferential phase of the engine output shaft to vary the injection timing.

In the above conventional injection timing control device, the pumping and distributing plunger is formed integrally with a cam disc which has a camming surface disposed in urging contact with the rollers on the roller holder for causing the plunger to be rotated and reciprocated at the same time. Due to the rotative contact of the cam disc with the roller, torque reaction force acts upon the rollers so as to cause circumferential vibration of the roller holder, which vibration is transmitted to the timer piston. As a consequence, fuel alternately gets into and out of the hydraulic oil chamber defined at one end of the timer piston, to amplify the axial vibration of the timer piston, resulting in unstable control of the injection timing during constant-speed or constant-load operation.

OBJECTS AND SUMMARY OF THE INVENTION

It is an object of the invention to provide an injection timing control device for use with a distributor-type fuel injection pump, which is provided with a servo valve disposed to separate the hydraulic oil chamber defined at one end of the timer piston from the suction chamber of the pump to keep the interior of the hydraulic oil chamber under constant pressure to thereby prevent vibration of the timer piston attributable to torque reaction force acting thereon, during constant-speed or constant-load operation.

It is a further object of the invention to provide an injection timing control device for use with a distributor-type fuel injection pump, which is provided with a servo valve which permits artificial adjustment of the timing of initiation of the injection timing control responsive to a change in the fuel pressure within the suction chamber of the pump, to thereby enable matching of the device with a fuel injection pump or an engine associated therewith.

According to the invention, servo valve means is arranged within the timer piston and across a passageway formed in the timer piston for supplying the hydraulic oil chamber with fuel pressure variable as a function of the rotational speed of an associated engine, and is actuatable in response to the above fuel pressure. The servo valve means is automatically displaceable relative to the timer piston in response to a change in the above fuel pressure, to open the above passageway at a first predetermined position thereof to allow feeding of the fuel pressure to the hydraulic oil chamber at one end of the timer piston for displacement of the timer piston in an injection timing advancing direction, open the same passageway at a second predetermined position thereof to allow escape of fuel pressure in the hydraulic oil chamber to a zone under lower pressure for displacement of the timer piston in an injection timing retarding direction, and close the same passageway at a third predetermined position thereof to hold the timer piston stationary.

The servo valve means comprises a valve body arranged to be urged at its one end face by the fuel pressure variable as a function of the engine rotational speed, a servo spring disposed to urge the valve body against the above fuel pressure, and a spring seat on which the servo spring is seated. The spring seat has a spirally extending end face remote from the servo spring and urged by an adjusting member arranged rotatably and eccentrically with respect to the axis of the spring seat and having an end disposed in urging contact with the above spiral end face. The adjusting member, when rotated, causes a change in the axial position of the spring seat to vary the setting load of the servo spring. The adjusting member is threadedly fitted in an eccentric hole formed in a rotary member stationary in axial position and is rotatable about its own axis for adjustment in position relative to the spring seat.

The above and other objects, features and advantages of the invention will be more apparent from the ensuing detailed description taken in connection with the accompanying drawings in which:

DETAILED DESCRIPTION

Figure 1:
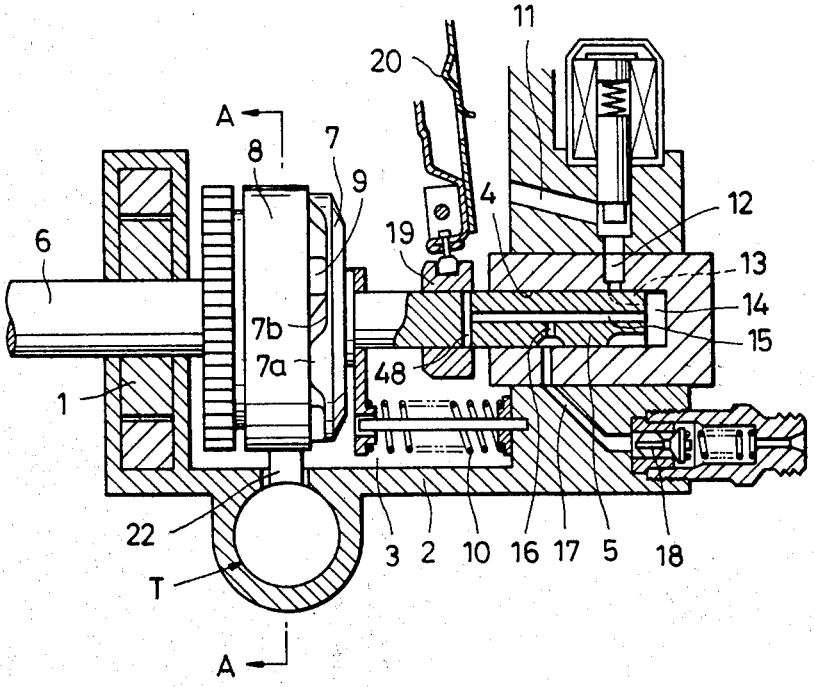
FIG. 1 PRIOR ART
FIG. 1 is a longitudinal sectional view of a typical distributor-type fuel injection pump.
Figure 2:
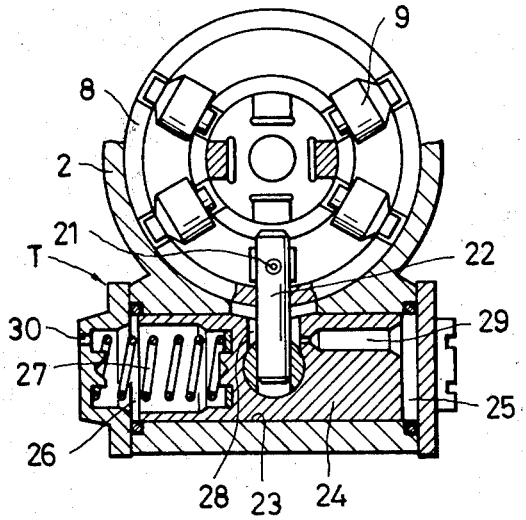
FIG. 2 PRIOR ART
FIG. 2 is a sectional view taken along line A—A in FIG. 1, illustrating a conventional injection timing control device.

Referring first to FIGS. 1 and 2, there are illustrated a typical distributor-type fuel injection pump and a conventional injection timing control device used in the same pump, respectively.

Fuel in a fuel tank, not shown, is sucked and pressurized by a feed pump 1 and delivered into a suction chamber 3 defined within a pump housing 2. The internal fuel pressure within the suction chamber 3, which is controlled by a pressure control valve, not shown, increases proportionately as the engine rpm increases.

A pumping and distributing plunger 5 is slidably arranged within a plunger bore 4 formed in the pump housing 2 and is adapted to be rotated and reciprocated at the same time. More specifically, a drive shaft 6 connected to the output shaft, not shown, of an engine associated with the pump is coupled to a cam disc 7 secured to an end of the plunger 5, via a driving disc, not shown, for rotation in unison with each other. The cam disc 7 has a camming surface *7a, 7b* formed at circumferentially equal intervals with highs *7a* corresponding in number to the number of the cylinders of the engine and urged by a plunger spring 10 against rollers 9 carried on a roller holder 8. Thus, as the drive shaft 6 rotates, the plunger 5 secured to the cam disc 7 is rotated for suction and delivery of fuel and simultaneously reciprocated for distribution of fuel to delivery valves 18.

When the plunger 5 is moved through its suction stroke, fuel in the suction chamber 3 is fed through a supply passage 11, a suction port 12 and one of a plurality of suction grooves 13 formed in the outer peripheral surface of the head of the plunger 5, into a pump working chamber 14. Then, when the plunger 5 is moved through its delivery stroke, the suction port 12 becomes separated from the above one of the suction grooves 13 as the plunger 5 rotates, so that fuel is compressed within the pump working chamber 14 and fed through a longitudinal channel 15 formed in the plunger 5 and a distributing port 16 in the same into one of a plurality of distributing passages 17 arranged at circumferentially equal intervals for respective delivery valves 18, and then injected into an engine cylinder, not shown, through an associated delivery valve 18 and an injection nozzle, not shown.

A fuel quantity setting sleeve 19 is slidably fitted on a portion of the plunger 5 projected into the suction chamber 3. As the plunger 5 is moved through its delivery stroke, the fuel quantity setting sleeve 19 has its one end edge disengaged from a transverse cut-off port 48 intersecting the longitudinal channel 15 to open the cut-off port 48 into the suction chamber 3 so that fuel in the channel 15 flows through the cut-off port 48 into the suction chamber 3 and accordingly the delivery of fuel to the delivery valve 18 is interrupted thus to terminate the injection of the delivery stroke of the plunger. The fuel quantity setting sleeve 19 can be varied in position relative to the plunger 5 by means of a known governor mechanism, not shown, through a lever 20 connected to the governor mechanism, to control the fuel injection quantity.

The roller holder 8 is pivotally arranged in concentricity with the plunger 5, to which is coupled one end of a lever 22 which has its other end engaging a timer piston 24 of an injection timing control device T.

In the injection timing control device T, the timer piston 24 is slidably received within a cylinder 23 formed integrally on the pump housing 2. Defined at opposite ends of the piston 24 are a hydraulic oil chamber 25 which is supplied with fuel from the suction chamber 3 and a chamber 26 within which a timer spring 27 is accommodated and urges an associated end face of the timer piston 24 against the fuel pressure in the chamber 25. Thus, the position of the timer piston 24 is determined by the relationship between the force of the timer spring 27 and the fuel pressure in the chamber 25, which in turn determines the circumferential position of the roller holder 8 engaging the timer piston 24 through the lever 22. A change in the circumferential position of the roller holder 8 which corresponds to a change in the position of the timer piston 24 causes a corresponding change in the point of contact between the rollers 9 and the camming surface *7a, 7b* of the cam disc 7, so that there occurs a change in the positional relationship between the circumferential phase of the drive shaft 6 and the axial operative position of the plunger 5, thus varying the injection timing with respect to the rotation of the drive shaft 6. In the illustrated embodiment, it is so arranged that a leftward displacement of the piston 37 against the force of the spring 27 as viewed in FIG. 2 causes a clockwise rotation of the roller holder 8 as viewed in FIG. 2 to cause an advance in the injection timing.

Fuel in the suction chamber 3 is guided to the hydraulic oil chamber 25 through a radial opening 28 formed in a middle portion of the piston 24 and a passage 29 formed in the piston 24 and communicating the opening 28 with the hydraulic oil chamber 25. The chamber 26 accommodating the timer spring 27 communicates with a zone under lower pressure through a communication hole 30 to permit movement of the piston 24.

According to the conventional injection timing control device T described above, the rollers 9 of the roller holder 8 rollingly engage alternately the highs *7a* and lows *7b* of the camming surface of the cam disc 7 being rotated so that torque reaction force acts upon the rollers 9 at high and low rates alternately, causing circumferential vibration of the roller holder 8. This circumferential vibration of the roller holder 8 is transmitted through the lever 22 to the timer piston 24 to cause axial vibration of the piston 24 irrespective of where or not there occurs a change in the fuel pressure in the suction chamber 3. This axial vibration of the piston 24 in turn causes alternate entrance and exit of fuel into and out of the hydraulic oil chamber 25, to amplify the axial vibration of the piston 24, rendering the injection timing control operation of the device T unstable and even exerting an unfavorable influence upon the operation of the engine.

Figure 3:
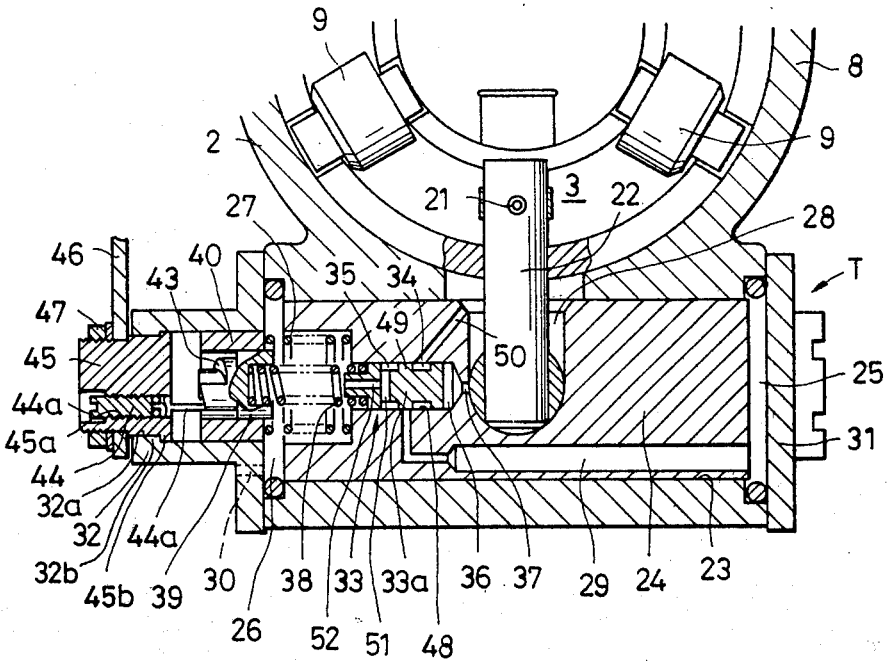
FIG. 3 is a longitudinal sectional view of an injection timing control device according to the present invention.

Referring next to FIG. 3, there is illustrated an injection timing control device T according to one embodiment of the present invention wherein like reference characters designate elements or parts corresponding to those shown in FIGS. 1 and 2. The timer piston 24 is slidably received within the cylinder 23, with the hydraulic oil chamber 25 provided at one end of the piston 24 and the chamber 26 at the other end thereof, respectively. The hydraulic oil chamber 25 is defined by an end face of the piston 24 and the inner walls of the pump housing 2 and a cover 31 secured to the cylinder 23. The chamber 25 can communicate with the suction chamber 3 through a passage 29, referred to hereinlater, formed in the timer piston 24 and a valve bore 48 also formed in the piston 24 across the passage 29, in which a servo valve 33 is slidably received. The valve bore 48 extends axially of the timer piston 24, in an inner peripheral surface of which opens one end of the passage 29. On the other hand, the chamber 26 is defined by the other end face of the timer piston 24 and the inner walls of the pump housing 2 and a cover 32 secured to the cylinder 23 and accommodates the timer spring 27 axially or rightwardly urging the timer piston 24 and a servo spring 38 referred to hereinlater. The chamber 26 communicates with the atmosphere through a communication hole 30 formed through the cover 32.

The servo valve 33, which is mounted within the valve bore 48 in which one end of the passage 29 opens as previously noted, comprises a valve body 33*a* in the form of a spool, which has its outer peripheral surface formed with an annular grooves 34, a land 49 and an annular groove 35 axially justaposed in the mentioned order from the right. The annular groove 35 on the side of the chamber 26 communicates with the chamber 26 through bores 51, 52 formed in the valve body 33*a*, while the other annular groove 34 can communicate with the suction chamber 3 through a passage 50 formed in the timer piston 24. A servo pressure chamber 36 is defined at one end of the servo valve 33, which communicates with the opening 28 via an orifice 37 to be supplied with fuel pressure from the suction chamber 3. The servo spring 38 urges at its one end the other end of the servo valve 33 to bias the valve 33 toward the servo pressure chamber 36.

Figure 4:
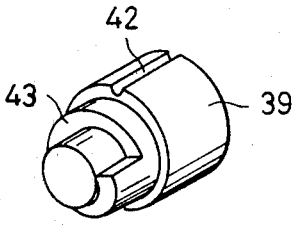
FIG. 4 is a perspective view of a valve seat used in the device of FIG. 3.
Figure 5:
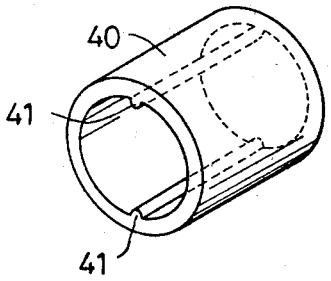
FIG. 5 is a perspective view of a sleeve used in the device of FIG. 3.

The servo spring 38 urges at its other end a spring seat 39 slidably fitted in a sleeve 40 secured in the cover 32. The spring seat 39 has its outer peripheral surface formed with longitudinal grooves 42 (FIG. 4) in which are engaged respective longitudinal ridges 41 formed on the inner peripheral surface of the sleeve 40. The spring seat 39 has an end face 43 remote from the servo spring 38, which is formed as a spiral face spirally extending at a suitable angle with respect to the axis of the seat 39. An adjusting screw 44 is formed integrally with an arm 44*a* at its one end and disposed in urging contact with the spiral end face 43 to determine the axial position of the spring seat 39. The adjusting screw 44 has its head end face formed with a minus groove 44*a* and is threadedly fitted in an eccentric threaded hole 45*a* axially formed through a rotary member 45 rotatably fitted in an open end 32*a* of the cover 32. By rotating the adjusting screw 44 with a driver or the like engaged in the minus groove 44*a*, the axial position of the spring seat 39 can be varied to thereby vary the setting load of the servo spring 38. The timing of initiation of the injection timing control action can be adjusted by thus varying the setting load of the servo spring 38.

The rotary member 45 is prohibited from axial movement away from the spring seat 39 by a flange 45*b* formed integrally thereon in engagement with an inward annular protuberance 32*b* formed integrally on an associated inner end of the cover 32. A lever 46 is fitted on an exteriorly exposed outer end of the rotary member 45 and tightened in place by a nut 47 threadedly fitted thereon. By rotating the lever 46 manually or by means of driving force of a suitable drive source, the adjusting screw 44 rotates about the axis of the rotating rotary member 45 in unison with the latter. Since the adjusting screw 44 is located eccentrically of the axis of the rotary member 45, it slides along the spiral end face 43 of the spring seat 39 as the rotary member 45 rotates, to vary the axial position of the spring seat 39 as previously noted.

The operation of the injection timing control device T constructed above will now be described. Before the start of the fuel injection pump, the timer piston 24 is biased in the leftmost position as viewed in FIG. 3 by the timer spring 27, with the passage 29 obturated by the land 49 on the servo piston 33. Then, with an increase in the engine rpm, the fuel pressure within the suction chamber 3 proportionately increases. Pressure-increased fuel is supplied to the servo pressure chamber 36 through the opening 28 and the orifice 37 to displace the servo piston 33 leftward against the force of the servo spring 38 so that the annular groove 34 becomes opposite the associated end of the passage 29. The passage 29 now communicates with the suction chamber 3 through the annular groove 34 and the passage 50 to allow fuel in the suction chamber 3 to flow into the hydraulic oil chamber 25 so that the timer piston 25 is displaced leftward by the fuel pressure in the chamber 25 against the force of the timer spring 27. As the timer piston 24 is this leftwardly moved, the setting load of the servo spring 38 increases above the fuel pressure in the chamber 36 to cause rightward movement of the servo piston 24 relative to the timer piston 24 until the passage 29 again becomes obturated by the land 49. When the passage 29 is thus closed, the pressure within the hydraulic oil chamber 25 no longer increases and held at a constant value so that movement of the timer piston 24 is interrupted. The leftward displacement of the timer piston 24 is transmitted to the roller holder 8 through the lever 22 to cause clockwise rotation of the roller holder 8 to obtain an advance in the injection timing, proportionate to the increase of the engine rpm.

When the engine rpm further increases, correspondingly increased fuel pressure urgingly displaces the servo piston 33 leftward against the force of the servo spring 38 in the same manner as previously mentioned, until the passage 29 is again opened to allow fuel to be again fed to the hydraulic oil chamber 25. Consequently increased fuel pressure in the chamber 25 causes leftward movement of the timer piston 24 against the force of the timer spring 27, obtaining a further advance in the injection timing, responsive to the further increase of the engine rpm.

On the other hand, when the engine rpm decreases, the servo piston 33 is rightwardly moved by the servo spring 33 so that the annular groove 35 of the servo spring 33 encounters the associated end of the passage 29, to communicate the hydraulic oil chamber 25 with the chamber 26 by way of the annular groove 35 and the communication bores 51, 52, allowing the fuel in the chamber 25 to escape into the chamber 26. As a consequence, the urging force of the timer spring 27 surpasses the pressure in the hydraulic oil chamber 25 so that the timer piston 24 is again rightwardly moved until the passage 29 becomes obturated by the land 33 of the servo valve 33, thus obtaining a retard in the injection timing, corresponding to the decrease of the engine rpm.

As mentioned above, according to the arrangement of the invention, the hydraulic oil chamber 25 is isolated from the suction chamber 3 by the action of the servo valve 33 during constant-speed operation and constant-load operation, except during movement of the timer piston 24 for control of the injection timing. Therefore, during isolation of the chamber 25 from the suction chamber 3, there occurs neither of entrance and exit of fuel into and out of the hydraulic oil chamber 25, thus preventing large vibration of the timer piston 24 due to torque reaction force acting upon the roller holder 8.

While a preferred embodiment has been described, variations thereto will occur to those skilled in the art within the scope of the present inventive concepts which are delineated by the following claims.

What is claimed is:

1. An injection timing control device for combination with a fuel injection pump of the type including a pumping and distributing plunger, and a roller holder carrying a plurality of rollers circumferentially arranged and disposed in camming engagement with an end face of said plunger, said injection timing control device comprising:

a cylinder;

a timer piston slidably received within said cylinder, said timer piston being coupled to said roller holder such that displacement thereof causes a corresponding change in the circumferential position of said roller holder;

a first chamber defined at one end of said timer piston;

a second chamber defined at another opposite end of said timer piston, said second chamber communicating with a zone under lower pressure;

a timer spring accommodated within said second chamber and axially urging said timer piston;

a passageway formed in said timer piston for supplying said first chamber with fuel pressure variable as a function of the rotational speed of an internal combustion engine associated with said fuel injection pump; and servo valve means arranged within said timer piston and across said passageway, said servo valve means being actuatable in response to said fuel pressure variable as a function of the rotational speed of said engine;

said servo valve means being automatically displaceable relative to said timer piston in response to a change in said fuel pressure, to open said passageway at a first predetermined position thereof to allow feeding of said fuel pressure to said first chamber for displacement of said timer piston in an injection timing advancing direction, to open said passageway at a second predetermined position thereof to allow escape of fuel pressure in said first chamber to said zone under lower pressure for displacement of said timer piston in an injection timing retarding direction, and to close said passageway at a third predetermined position thereof to hold said timer piston stationary;

said servo valve means comprising:

a valve bore axially formed in said timer piston;

a valve body slidably fitted in said valve bore, said valve bore having end faces, an outer peripheral surface formed with a land and first and second annular grooves arranged in axial juxtaposition, said valve body being arranged to be urged at one of said end faces thereof by said fuel pressure variable as a function of the engine rotational speed, said first annular groove being disposed to communicate with a suction chamber of said fuel injection pump to be supplied with fuel pressure variable as a function of the engine rotational speed, said second annular groove communicating with said second chamber;

a servo spring disposed to urge another of said end faces of said valve body against said fuel pressure variable as a function of the engine rotational speed;

a spring seat on which said servo spring is seated, said spring seat having an axis and a spirally extending end face remote from said servo spring; and an adjusting member arranged rotatably and eccentrically with respect to the axis of said spring seat and having an end disposed in urging contact with said spiral end face of said spring seat;

whereby said adjusting member, when rotated about said axis of said spring seat, causes a change in the axial position of said spring seat to thereby vary the setting load of said servo spring;

said valve body being disposed such that said passageway encounters said first annular groove at said first predetermined position of said servo valve means, said second annular groove at said second predetermined position of said servo valve means, and said land at said third predetermined position of said servo valve means, respectively.

2. The injection timing control device as claimed in claim 1, including a rotary member arranged stationary in axial position and formed with an eccentric hole axially extending therethrough and in which said adjusting member is fitted, said eccentric hole in said rotary member having a threaded inner peripheral surface; and wherein said adjusting member comprises a threaded member threadedly fitted in said eccentric hole of said rotary member and is rotatable about an axis thereof for adjustment in position relative to said spring seat.

3. The injection timing control device as claimed in claim 2, including a stationary hollow cylindrical member in which said spring seat is axially fitted, said hollow cylindrical member having an inner peripheral surface and said spring seat having an outer peripheral surface, at least one longitudinal groove formed in one of said outer peripheral surface of said spring seat and said inner peripheral surface of said holow cylindrical member, and at least one ridge formed on the other of said outer peripheral surface of said spring seat and said inner peripheral surface of said hollow cylindrical member and slidably engaged in respective ones of said at least one longitudinal groove, whereby said spring seat is non-displaceable circumferentially but is displaceable axially, relative to said hollow cylindrical member.

* * * * *

UNITED STATES PATENT AND TRADEMARK OFFICE

CERTIFICATE OF CORRECTION

PATENT NO. : 4,408,591

DATED : October 11, 1983

INVENTOR(S) : Hisashi NAKAMURA

It is certified that error appears in the above-identified patent and that said Letters Patent is hereby corrected as shown below:

Column 7, line 40, change "valve bore having end faces" to --valve body having end faces--.

Signed and Sealed this

Seventh Day of February 1984

[SEAL]

*Attest:*

GERALD J. MOSSINGHOFF

*Attesting Officer*

*Commissioner of Patents and Trademarks*